US010033128B1

(12) United States Patent
Ranta

(10) Patent No.: US 10,033,128 B1
(45) Date of Patent: Jul. 24, 2018

(54) DISCONNECT ASSEMBLIES WITH PULL OUT CLIPS AND RELATED ELECTRICAL APPARATUS AND METHODS

(71) Applicant: Eaton Corporation Power Limited, Cleveland, OH (US)

(72) Inventor: Michael John Ranta, Morton, IL (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/596,132

(22) Filed: May 16, 2017

(51) Int. Cl.

| | |
|---|---|
| ***H01R 13/42*** | (2006.01) |
| ***H01R 13/426*** | (2006.01) |
| ***H01R 13/508*** | (2006.01) |
| ***H01R 12/72*** | (2011.01) |
| ***H01R 31/06*** | (2006.01) |
| *H01R 13/631* | (2006.01) |
| *H01R 12/71* | (2011.01) |

(52) U.S. Cl.
CPC ..... *H01R 13/426* (2013.01); *H01R 12/727* (2013.01); *H01R 13/508* (2013.01); *H01R 31/06* (2013.01); *H01R 12/712* (2013.01); *H01R 13/42* (2013.01); *H01R 13/6315* (2013.01)

(58) Field of Classification Search
CPC ..... H01R 2201/26; H01R 12/675; H01R 13/193; H01R 13/71; H01R 25/003; H01R 12/616; H01R 13/506; H01R 13/582; H01R 13/6335; H01R 13/641; H01R 13/665; H01R 13/6658; H01R 13/701; H01R 13/713
See application file for complete search history.

(56) References Cited

U.S. PATENT DOCUMENTS

| | | | | |
|---|---|---|---|---|
| 2,907,849 | A | 10/1959 | Kobryner | |
| 4,283,100 | A * | 8/1981 | Griffin | H01R 31/08 361/823 |
| 4,404,521 | A * | 9/1983 | Fennell | G01R 11/04 324/110 |
| 4,851,963 | A | 7/1989 | Miller et al. | |
| 5,406,449 | A | 4/1995 | Hicks et al. | |
| 5,906,508 | A * | 5/1999 | Jeffcoat | H01H 9/085 200/308 |
| 5,971,801 | A * | 10/1999 | Kato | B60L 3/0069 439/157 |
| 6,459,354 | B2 * | 10/2002 | Konda | H01H 9/085 200/17 R |
| 7,458,846 | B2 * | 12/2008 | Loehr | G01R 11/04 361/663 |
| 8,193,459 | B2 | 6/2012 | Abroy | |
| 8,420,960 | B1 | 4/2013 | Ranta | |
| 8,700,224 | B2 * | 4/2014 | Mathiowetz | H02J 3/14 700/295 |
| 8,882,532 | B1 * | 11/2014 | Akiyama | H01R 13/62977 439/372 |
| 2006/0110948 | A1 * | 5/2006 | Gerard | H01R 13/652 439/21 |

(Continued)

*Primary Examiner* — Truc Nguyen
(74) *Attorney, Agent, or Firm* — Myers Bigel, P.A.

(57) ABSTRACT

Disconnect assemblies include a lug assembly with at least one lug and a pull out disconnect assembly comprising at least one inwardly extending electrically conductive clip/clip leg. The one of the at least one inwardly extending clip abuts an outer wall of one of the at least one lug to thereby provide direct electrical connection of lugs to clips/clip legs without blades and jaws.

21 Claims, 11 Drawing Sheets

(56) References Cited

U.S. PATENT DOCUMENTS

| | | | | |
|---|---|---|---|---|
| 2009/0034168 | A1* | 2/2009 | Seff | G01R 11/04<br>361/660 |
| 2013/0134781 | A1* | 5/2013 | Kang | G06Q 10/06<br>307/31 |
| 2016/0055993 | A1* | 2/2016 | Salaki | H01R 43/16<br>200/50.39 |

* cited by examiner

DISCONNECT ASSEMBLIES WITH PULL OUT CLIPS AND RELATED ELECTRICAL APPARATUS AND METHODS

FIELD OF THE INVENTION

The present disclosure relates to disconnect assemblies particularly suitable for air conditioning systems.

BACKGROUND OF THE INVENTION

Disconnect devices for electrical systems are often employed in building wiring systems. A disconnect device typically includes a dedicated enclosure that houses a disconnect assembly for disabling one or more selected electrical circuits. For example, a disconnect assembly may house conductors that are part of an electrical circuit that provides power to an air conditioner, a refrigeration unit, or other equipment that draws electrical power. The disconnect assembly can be used to disconnect power from the electrical circuit so that equipment powered by the circuit may be serviced safely. The disconnect device may include a housing with one or more locking features, such as a lockable enclosure door, that allow service personnel to disconnect the electrical power to a circuit and then lock the disconnect housing door to prevent other personnel from re-connecting power to the circuit.

Conventional disconnect assemblies comprise a handle, base, lugs, jaws and blades and electrical connection and disconnection is through the blades engaging or disengaging the jaws, hence the blades. See, e.g., U.S. Pat. No. 8,420,960, the content of which is hereby incorporated by reference as if recited in full herein. As the blades move to engage and disengage the jaws, arcing can occur which can degrade, damage or deteriorate the contact surfaces of the jaws and blades.

SUMMARY OF EMBODIMENTS OF THE INVENTION

Embodiments of the present invention provide disconnect assemblies with pull out clips attached to a handle that are electrical connectors to the lugs.

Embodiments of the present invention do not require jaws and blades for electrical connection, i.e., they can be "bladeless".

Embodiments of the invention are directed to disconnect assemblies. The assemblies include a lug assembly with at least one lug held in a non-conductive lug housing and a pull out disconnect assembly comprising a non-conductive base holding at least one inwardly extending electrically conductive clip. One of the at least one inwardly extending clip abuts an outer wall of one of the at least one lug.

The outer wall of the at least one lug can have a profile with first and second peaks separated by a valley. The valley can define a primary electrical contact surface for electrical engagement with a primary contact surface at a medial segment of a respective clip during normal operation.

The pull out disconnect assembly can include a handle and the first peak can be closer to the handle than the second peak. The second peak may project outward from the valley further than the first peak.

The at least one clip can be provided as at least one clip body with downwardly extending first and second legs joined by a crown segment. The crown segment can be held by a base of the pull out assembly. The first and second legs can have a free end portion with an arcuate bend that is spaced apart from a medial segment that has an arcuate portion. The arcuate portion can define a primary contact surface that engages a medial segment of the outer wall of the lug during operation. The first leg can contact a first lug of the at least one lug and the second leg can contact an adjacent spaced apart second lug of the at least one lug in a space between the first and second lugs.

The lug assembly can be held in a non-conductive lug housing. The at least one lug can be a plurality of spaced apart lugs held in the lug housing. The at least one clip can be provided as first and second clip bodies, each with first and second inwardly extending clip legs joined by a crown at a first end portion. The crown can be attached to a non-conductive base of the pull-out disconnect assembly.

The first and second clip legs can face each other and reside inside a space between pairs of adjacent lugs.

The first and second clip legs can include a medial segment spaced apart from the first end segment between the first end segment and a second free end segment. The medial segment can include an arcuate portion that defines a primary electrical contact surface with a primary contact surface of an aligned one of the lugs and can have an angular extent in a range of 30-90 degrees.

The free end segment can have a window that resides below or behind the primary contact surface of the clip leg.

The legs can have a width that is in a range of 0.25 inches and 1 inch.

The second free end segment can have an arcuate bend and can have a linear extent that is less than a linear extent of the arcuate portion. The primary contact surface of the lugs can have an arcuate profile that corresponds to the primary contact surface of the clip legs.

The adjacent lugs can include first and second lugs with an inner facing sidewall with a curved valley that faces each other as the outer wall that abuts a respective clip, wherein the inner facing sidewall of the first lug abuts the first leg and the inner facing sidewall of the second lug abuts the second leg.

The lug housing can have a back wall or floor with a molded rail or a molded slot that slidably receives a matable feature in the lug.

Embodiments of the invention are directed to electrical apparatus. The apparatus includes an enclosure, a lug assembly with an electrically non-conductive lug housing attached to a back wall of the enclosure, and a plurality of inwardly extending lugs with an inner facing sidewall having a profile with a valley separating first and second peaks. The valley can provide a primary electrical contact surface. The apparatus also includes a pullout disconnect assembly with a handle and a plurality of inwardly extending curvilinear clip legs. The clip legs abut and directly electrically engage respective lugs to thereby provide an electrical path for current from a conductor held by the lug to an electrical circuit.

A medial segment of the clip legs can have an arcuate portion that provides a primary contact surface with the primary electrical contact surface of the lugs during operation.

The first peak can be closer to the handle than the second peak and the second peak can project outward from the valley further than the first peak The clip legs can be provided as first and second clip bodies, each can have downwardly/inwardly extending first and second legs as the clip legs, joined by a crown segment. The crown segment can be held by a base of the pull out disconnect assembly. The first and second legs of the first and second clip bodies can each have a free end portion with an arcuate bend that is spaced apart from the medial segment. The first leg can contact a first lug and the second leg can contact an adjacent spaced apart second lug inside a space between the first and second lugs of the plurality of lugs of the lug assembly.

The crown can be attached to a non-conductive base of the pull-out disconnect assembly.

First and second neighboring clip legs can face each other and reside inside a space between adjacent lugs.

The arcuate portion of the medial segment can have an angular extent in a range of 30-90 degrees. The legs have a width that is in a range of 0.25 inches and 1 inch.

The free end segment can have an arcuate bend and can have a linear extent that is less than a linear extent of the arcuate portion. The primary contact surface of the lugs can have an arcuate profile that corresponds to the primary contact surface of the clip legs.

The free end segment can comprise a window that resides below or behind the primary contact surface of the clip leg.

The lug housing can have a back wall or floor with a molded rail or a molded slot that slidably receives a matable feature in the lug.

Still other embodiments are directed to methods of engaging and disengaging lugs in a disconnect assembly. The methods include: inserting a handle comprising a plurality of inwardly extending laterally spaced apart clip legs into a housing holding a lug assembly with a plurality of laterally spaced apart lugs; in response to the inserting, the clip legs directly contact the lugs to electrically connect the clip legs to the lugs and connect an electrical circuit; and pulling the handle with the clips outward away from the lugs to separate the clips from the lugs and disconnect the electrical circuit.

Optionally, the inserting can be carried out to cause all of the clip legs to concurrently contact different lugs in the lug assembly with neighboring clip legs facing each other inside a space between adjacent lugs.

Optionally, the pulling can be carried out to cause all of the clip legs to concurrently separate from the different lugs.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
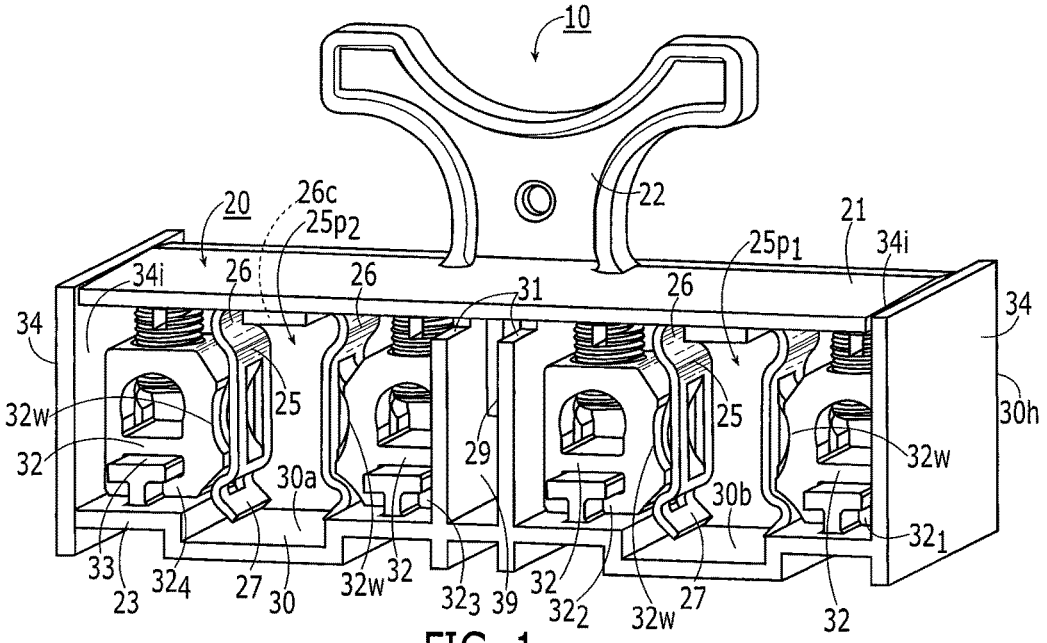
FIG. 1 is a perspective view of an exemplary disconnect assembly according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10'"). The terms "Fig." and "FIG." may be used interchangeably with the word "Figure" as abbreviations thereof in the specification and drawings. In the figures, certain layers, components or features may be exaggerated for clarity, and broken lines illustrate optional features or operations unless specified otherwise.

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Embodiments of the invention are particularly suitable for disconnect assemblies (which can also be described as "disconnect switches") for electrical systems or devices such as, but not limited to, circuits from a power source to a load, such as a major electrical appliance including, for example, an air conditioner, heater, refrigerator and the like.

Figure 2:
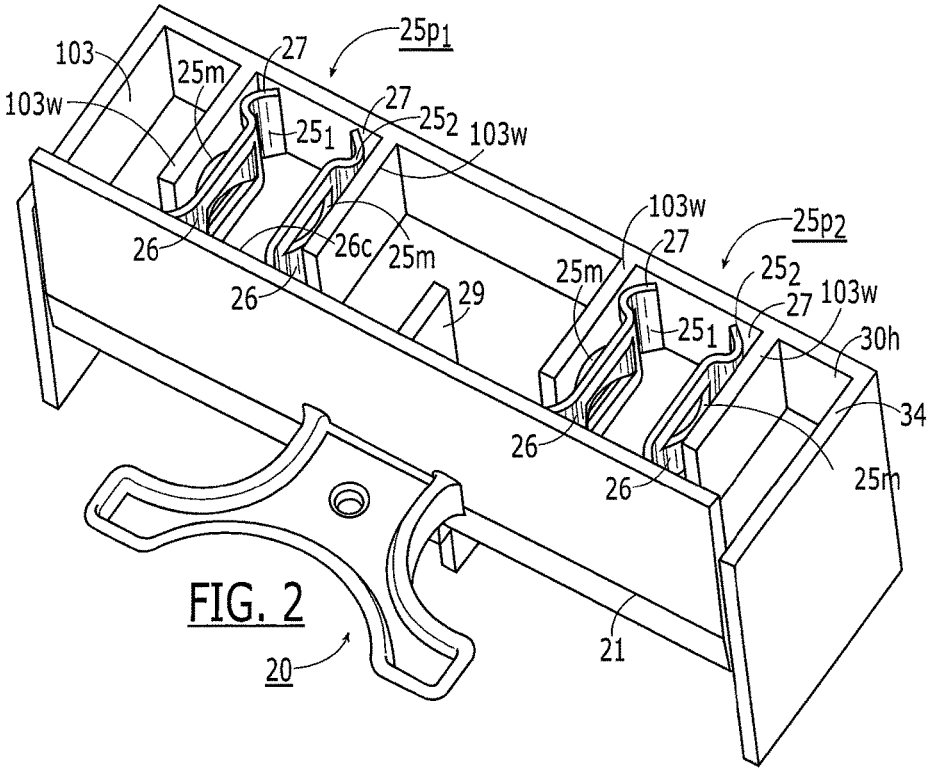
FIG. 2 is a side perspective view of the handle assembly of the disconnect assembly shown in FIG. 1 in an OFF (and stored position) according to embodiments of the present invention.

FIG. 1-FIG. 3 illustrate an example embodiment of a disconnect assembly 10. The disconnect assembly 10 comprises a handle pullout assembly 20 and a cooperating lug assembly 30. The lug assembly 30 includes a base housing 30*h* that holds at least one lug 32, shown as four spaced apart lugs $\mathbf{32}_1$, $\mathbf{32}_2$, $\mathbf{32}_3$, $\mathbf{32}_4$, but more or less lugs can be used in different embodiments. The handle pullout assembly 20 can include a base 21 with an outwardly facing handle 22 and at least one inwardly extending electrically conductive clip 25. Typically, there is one clip 25 (or clip leg 25*l*) for each lug 32, shown as four clip legs from four clips 25 (or four clip legs from two clips with pairs of clip legs 25*l*) for four lugs 32.

As shown in FIG. 1 and FIG. 3, for example, the lugs 32 can have an inner facing sidewall 32*w* with a curvilinear contour that, in normal operating position, contacts a primary electrical contact zone 25*c* of the clip about a medial segment 25*m* of the clip 25. The other opposing sidewall 32*o* can be planar or have another different shape and can abut a wall 30*w* of the base housing 30*h*.

The clip 25 has an electrically conductive primary electrical contact surface 25*c* that is at a medial segment 25*m* of the clip. The contact surface 25*c* can be concave and the lug 32 can have a sidewall 32*w* that has medial segment that has a matably configured shape as the primary contact surface 25*c* of the clip, and can be convex, and forming a lug primary contact surface 32*c*.

A respective clip 25 contacts a corresponding lug 32 and provides an electrical path from a conductor (i.e., cable or wire) held by the lug 32 to a load and/or other electrical circuit as is well known to those of skill in the art.

The base housing 30*h* can include a plurality of compartments, shown as two adjacent compartments, 30*a*, 30*b*, with planar walls 31 that can abut one wall of a respective lug 32. The inner surfaces 34*i* of the outer walls 34 of the housing 30*h* can abut the other lugs 32.

In some embodiments, the lug assembly 30 includes four lugs 32 that are electrically insulated from one another. Lugs $\mathbf{32}_1$ and $\mathbf{32}_2$ can be configured to be connected in series with a conductor that provides electrical power to a first phase of the air conditioning circuit. The lug $\mathbf{32}_1$ can be connected to an output portion of the conductor while the lug $\mathbf{32}_2$ can be connected to an input portion of the conductor. The lugs $\mathbf{32}_3$ and $\mathbf{32}_4$ can be configured to be connected in series with a conductor that provides electrical power to a second phase of the air conditioning circuit. The lug $\mathbf{32}_3$ can be connected to an input portion of the conductor while the lug $\mathbf{32}_4$ can be connected to an output portion of the conductor.

Referring to FIG. 2 and FIG. 3, the at last one clip 25 can have a first end portion 26 that is adjacent the base 21 and an opposing second end portion 27 that can be a free end portion. The second end portion 27 can have an arcuate bend 27*b*, as shown.

The end portion 26 of the at least one clip 25 adjacent the base 21 can be moldably attached to the inside of the base 21. The at least one clip 25 can be provided as first and second pairs of clips $\mathbf{25}p_1$, $\mathbf{25}p_2$.

Figure 3B:
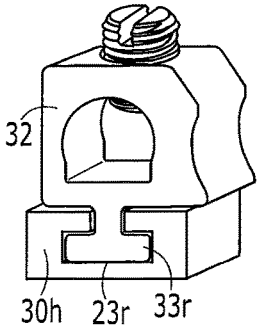
FIG. 3B is a side perspective illustration of another embodiment of a lug for the lug assembly shown in FIG. 1 according to embodiments of the present invention.
Figure 3A:
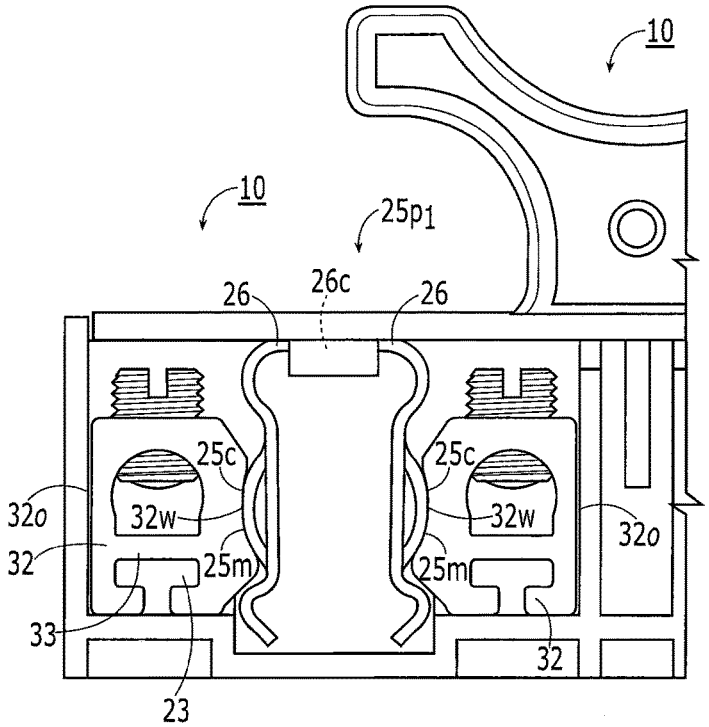
FIG. 3A is a partial top view of the disconnect assembly shown in FIG. 1.
Figure 4A:
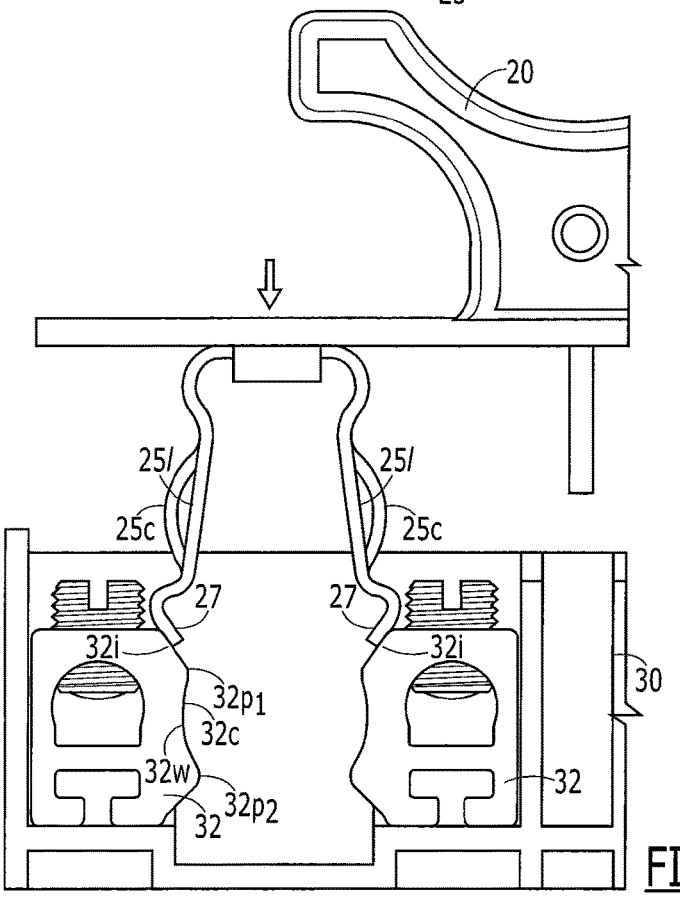
FIG. 4A-FIG. 4D are enlarged, partial top views of the disconnect assembly shown in FIG. 1 showing an exemplary assembly sequence according to embodiments of the present invention.
Figure 4B:
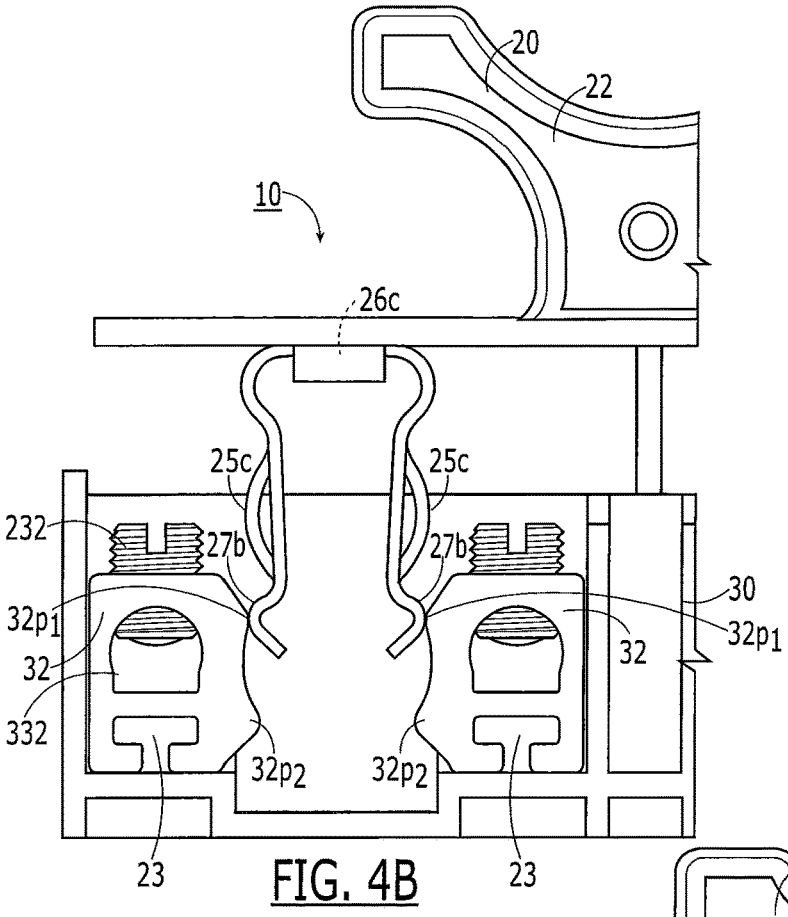
Figure 4C:
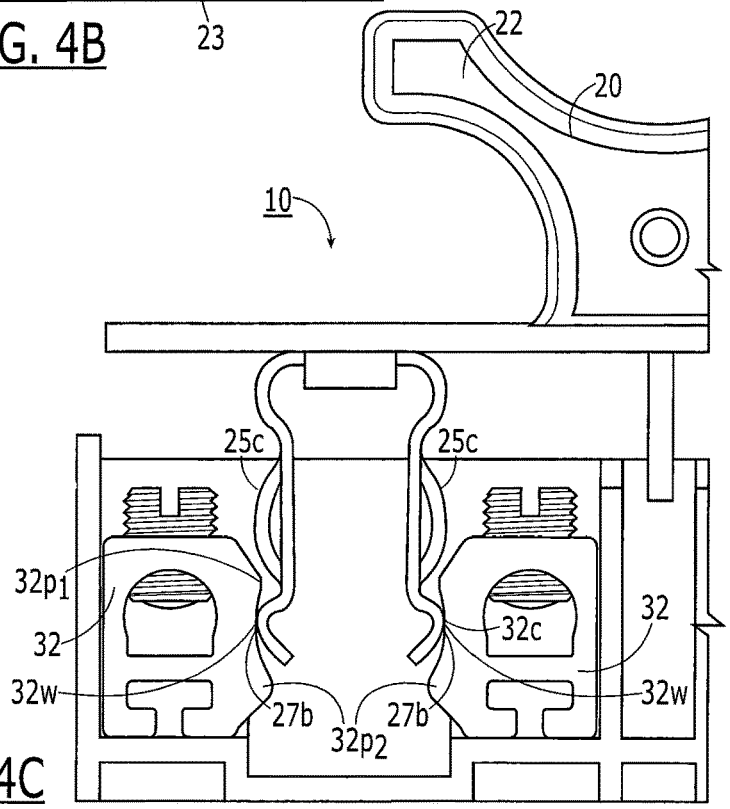
Figure 4D:
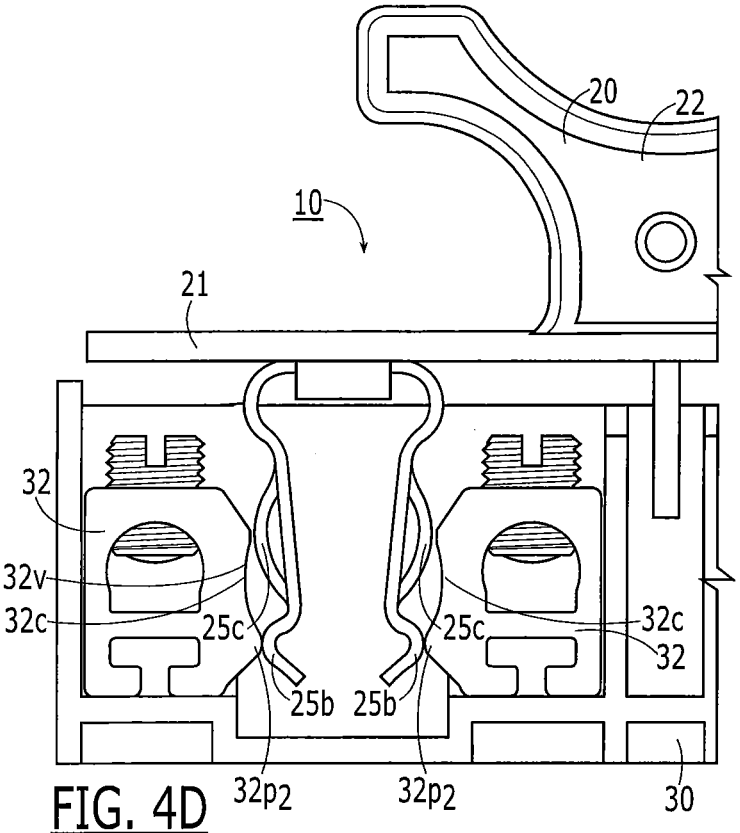
Figure 5:
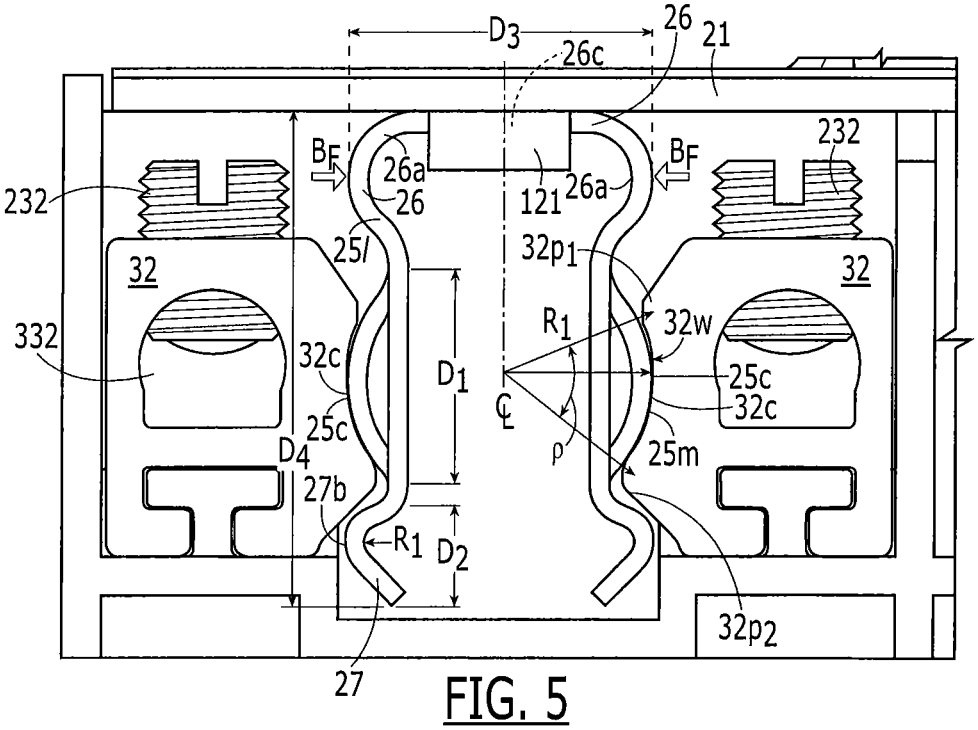
FIG. 5 is a greatly enlarged, partial top view of the disconnect assembly shown in FIG. 1 according to embodiments of the present invention.

FIGS. 4A-4E (with FIGS. 3A and 5 showing the final conduction ON assembly configuration) illustrate a sequential series of shapes/assembly actions that can be carried out to electrically engage electrical contact surfaces of the clips 25*c* only when properly aligned with a matable primary electrical contact segment 32*c* of the lug 32 according to embodiments of the present invention. The second (free end) portion 27 of the clip 25 can contact the lug wall 32*w* during assembly which may allow arcing. Thus, the second end portion 27 of the clip can be "sacrificial" and can be configured to cooperate with the lug wall during insertion and removal to protect the contact surface of the lug 25*c* and a primary contact surface of the lug 32*c*. The primary electrical contact surface 25*c* of the clip 25 can be conformable to the primary contact surface or segment 32*c* of the lug 32.

The lug 32 can have a profile that cooperates with the shape of the clip to help preserve the contact surface of the clip 25*c*. The sidewall 32*w* of the lug can have a profile or perimeter shape with first and second peaks, 32$p_1$, 32$p_2$ on either side of a valley 32*v* with the valley 32*v* providing the "home" surface for the primary contact surface 25*c* of the clip (FIG. 5). This profile can be described as a cam surface with a cam lobe profile. The second (innermost) peak 32$p_2$ can project outward toward the opposing lug wall 32*w* a greater distance than the first peak 32$p_1$. The peaks 32$p_1$, 32$p_2$ can have rounded or curved outer surfaces. The valley 32*v* can also be rounded and can have a radius of curvature $R_1$ (FIG. 5) corresponding to that of the arc segment 25*a* of the clip contact surface 25*c*.

Referring to FIG. 4A, upon initial engagement, the second end portion 27 contacts an inclined (inwardly tapered) wall segment 32*i* of the lug 32 which guides the clip legs 25*l* inward as the clips travel into the lug assembly 30. Referring to FIGS. 4B and 4C, as the clip 25 moves further into the base housing 30*h*, the outer surface of the bend segment 27*b* contacts the first peak segment 32$p_1$ of the lug wall and this bend segment 27*b* acts as a cam follower traveling over the primary contact surface 32*c* of the lug and keeps the contact surface 25*c* of the clip away from the lug 32.

Referring to FIG. 4D, as the bend segment 27*b* contacts the second peak 34$p_2$, the contact surfaces 25*c* are almost aligned with the valley 32*v* or primary contact surfaces 32*c* of the lug but are spaced apart from any contact with the lug. Once the bend segment 27*b* travels past the second peak 32$p_2$, the clip legs 25*l* spread and allow the primary contact surfaces 25*c* to contact the primary contact surfaces 32*c* of the lugs 32. In a normal operating position (FIG. 3A, 5), with the primary contact surfaces 32*c*, 25*c* engaged and abutting, the free ends 27 can extend closer to the wall of the base housing 30*h* (i.e., back wall) than the lugs 32. Upon removal, the opposite actions between the clip body and lug wall can occur, which again protect the primary contact surface 25*c* from contacting the lug 32.

The base 21 of the pull out assembly 20 can be molded. The base 21 can be of an electrically insulating material and may be molded of a suitable polymeric and/or plastic material, such as, for example a thermoplastic material optionally comprising polyphenylene/polystyrene.

The base housing 30*h* of the lug assembly 30 can also be formed of an electrically insulating material and may be molded of a suitable polymeric and/or plastic material, such as, for example a thermoplastic material optionally comprising polyphenylene/polystyrene. The base housing 30*h* can be the same material as the pullout assembly base 21. The base housing 30*h* can be a different material from the pullout assembly base.

Referring to FIGS. 4B and 5, for example, the lug 32 can comprise a fastener 232 that can tighten against and engage a wire or other conductor held in the cable channel 332 of the lug 32.

The lug 32 comprises a conductive material such as aluminum. The fastener 232 can comprise steel or other suitable material.

Referring to FIG. 5, the medial portion of the clip 25*m* can have an arc segment 25*a* as the primary contact surface 25*c* that extends an angular distance β, over a distance corresponding to the radius of curvature of the lug sidewall 32*w*, typically between 30-120 degrees, more typically between 40-90 degrees, such as about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees and about 90 degrees, measured from a longitudinally extending centerline (C/L) between adjacent lugs 32 or between legs 25*l* of a clip 25. The radius $R_1$ (also measured from the noted longitudinally extending centerline (C/L) can be between 0.25 inches and 1 inch, in some embodiments. The radius $R_1$ can be about 0.25 inches, about 0.3 inches, about 0.4 inches, or about 0.5 inches, in some embodiments.

The second end portion 27 of the clip 25 can have an arcuate bend 27*b* with a radius of curvature $R_2$ that is steeper than the radius of curvature $R_1$ of the medial segment and that extends over a shorter distance D2.

The arcuate segment of the medial portion 25*m* of the clip 25 can have a first straight linear extent D1 and the bend segment 27*b* can have a second straight linear extent D2, with D2<D1. Typically, D2 is 10-50% the distance of D1.

A clip pair 25$p_1$, 25$p_2$, for example, can have first end portions 26 adjacent the base 21 connected by the crown 26*c* with a cumulative distance D3. The clip 25 can have a fourth linear extent dimension D4 corresponding to a cumulative or overall length of a clip leg 25*l*. D4 is typically greater than D3.

Figure 7A:
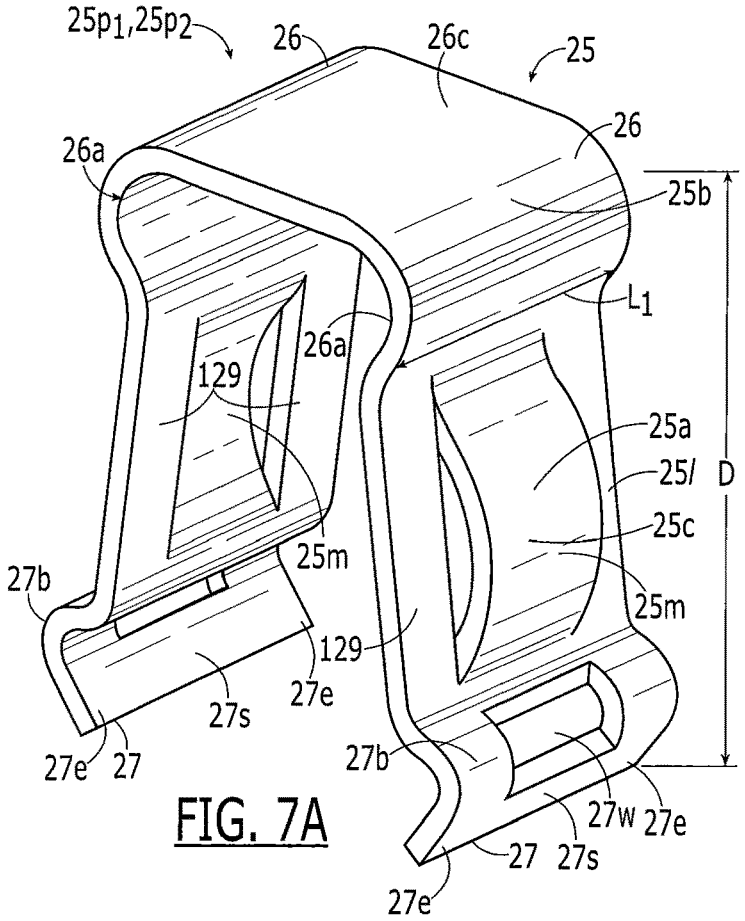
FIG. 7A is a side perspective view of an exemplary electrical connector clip according to embodiments of the present invention.
Figure 7B:
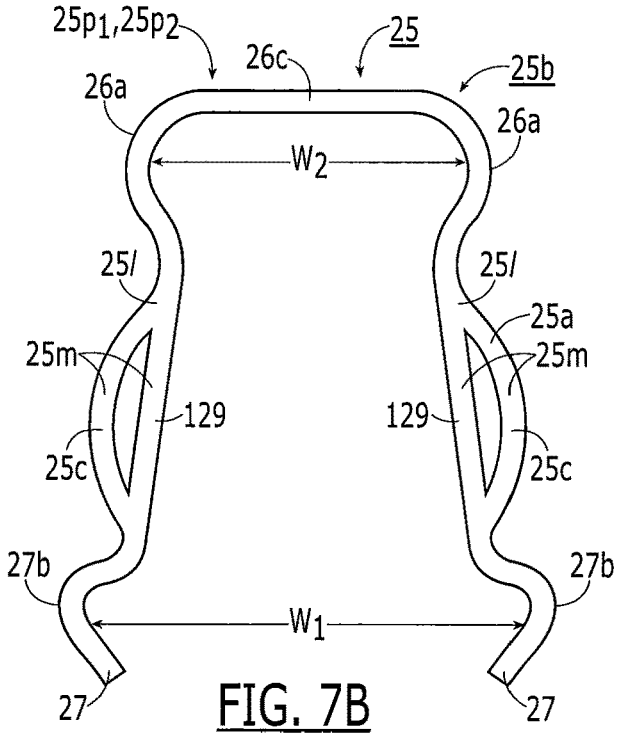
FIG. 7B is a front view of the clip connector shown in FIG. 7A.

Referring to FIG. 5, FIG. 7A and FIG. 7B, a single clip body 25*b* or a respective clip pair 25$p_1$, 25$p_2$, can be configured with first and second spaced apart clip legs 25*l* that are joined at a crown 26*c*. That is, the clip body 25*b* and/or clip pairs 25$p_1$, 25$p_2$ can be a unitary three-dimensionally shaped member with the arc and bend segments 26*a*, 25*a*, 27*b*. The clips 25 can have a first end portion 26 merges into a flat crown shape 26*c* that joins the adjacent clip legs 25*l*.

Referring to FIG. 7A, the medial portion 25*m* of the clips 25 or clip body 25*b* can include planar parallel members 129 that reside across from the arc segment 25*a* and that merge into a unitary solid laterally extending segment adjacent the first end portion 26 of the clip 25. The bend segment 27*b* can include a slot or window 27*w* with a laterally and longitudinally extent as shown or may be a continuous solid closed surface (not shown). The term "window" is used broadly to refer to an open gap space with both a lateral extent (direction L1, FIG. 7A) and a longitudinal extent (direction D, FIG. 7A) and may be open in its longitudinal extent (i.e., FIG. 8B). In some embodiments, the window 27*w* is formed by an open gap space between opposing sides of the arcuate bend segments 27*b* associated with a width dimension of the leg 25*l* and lug 32 (direction L1, FIG. 7A).

Figure 8A:
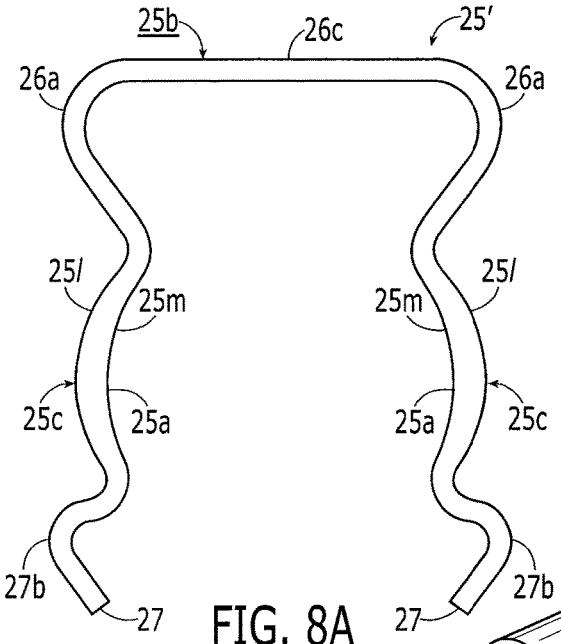
FIG. 8A is a front view of another embodiment of a clip connector according to embodiments of the present invention.
Figure 8B:
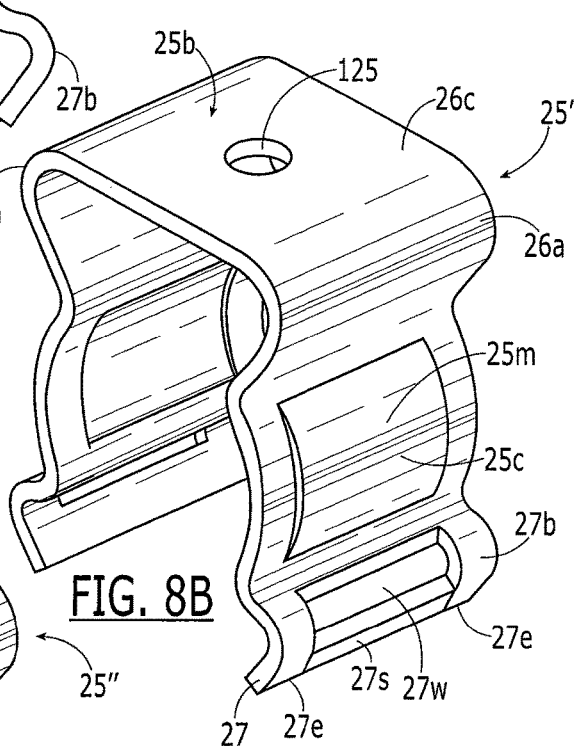
FIG. 8B is a side perspective view of the electrical connector shown in FIG. 8A according to embodiments of the present invention.
Figure 8C:
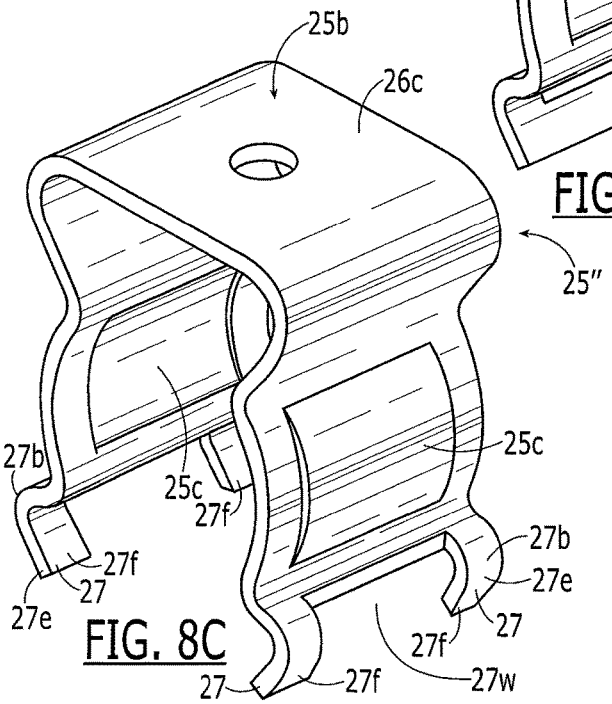
FIG. 8C is a side perspective view of another embodiment of the electrical connector shown in FIG. 8A according to embodiments of the present invention.

FIGS. 8A and 8B illustrate another embodiment of a clip 25' with a clip body 25*b*. The clip body 25*b* can have a crown 26 and can include an aperture 125. The primary contact surface 25*c* can have a solid continuous surface at this segment and does not require the planar parallel members 129 that reside across from the arc segment 25*a*. FIG. 8C illustrates another embodiment of a clip 25" with a similar clip body 25*b* to that shown in FIG. 8B, but the lower segment 27 has laterally spaced apart fingers 27*f*.

This window or slot 27*w* can be sized and configured to protect the primary contact surface of the lug 32*c* as the bend segment 27*b* of the clip 25 travels to its ON position.

The lower end portion 27 of the clip leg 25*l* can have laterally opposing ends 27*e* that can be attached across a laterally extending segment 27*s* as shown in FIGS. 7A and 8B, for example. The opposing ends 27*e* can be detached and spaced apart free ends 27*e* forming inwardly extending fingers 27*f* (FIG. 8C).

The clip 25 comprises an electrically conductive material and can comprise copper. The clip 25 can comprise a copper alloy. The clip 25 can be a multi-layer device with a plurality of different materials such as a multi-layer configuration of copper or copper alloy, tin, and/or silver plated coatings or layers.

As shown in FIG. 7B, when not under load, the first and second legs 25*l* position respective first and second free ends 27 apart a distance $W_1$ that is greater than the distance $W_2$ of the clips adjacent the crown 26*c*. The arcuate segment 26*a* can be configured to deflect in response to movement or position of the free end 27 and/or can be subject to bending forces $B_F$ in the operative position shown in FIG. 5, for example.

The crown 26*c* can be attached to the base 21 such as via a projection 121 which can optionally be an overmolded or integrally molded feature over the crown 26*c*.

Figure 9A:
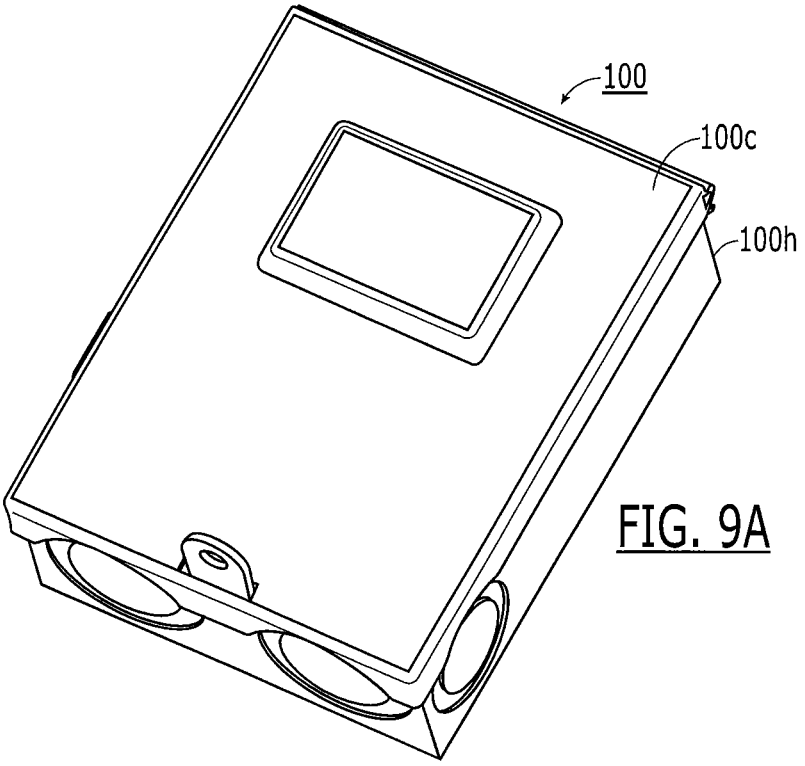
FIG. 9A is a front perspective view of an electrical apparatus with an enclosure holding the disconnect assembly according to embodiments of the present invention.
Figure 9B:
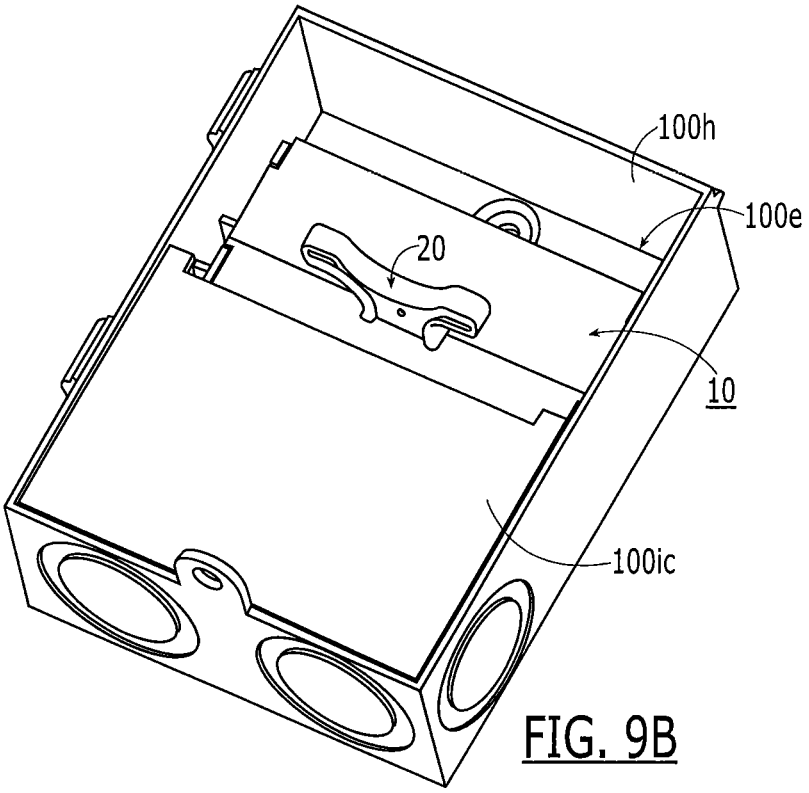
FIG. 9B is a front perspective view of the apparatus shown in FIG. 9A without the external cover according to embodiments of the present invention.
Figure 9C:
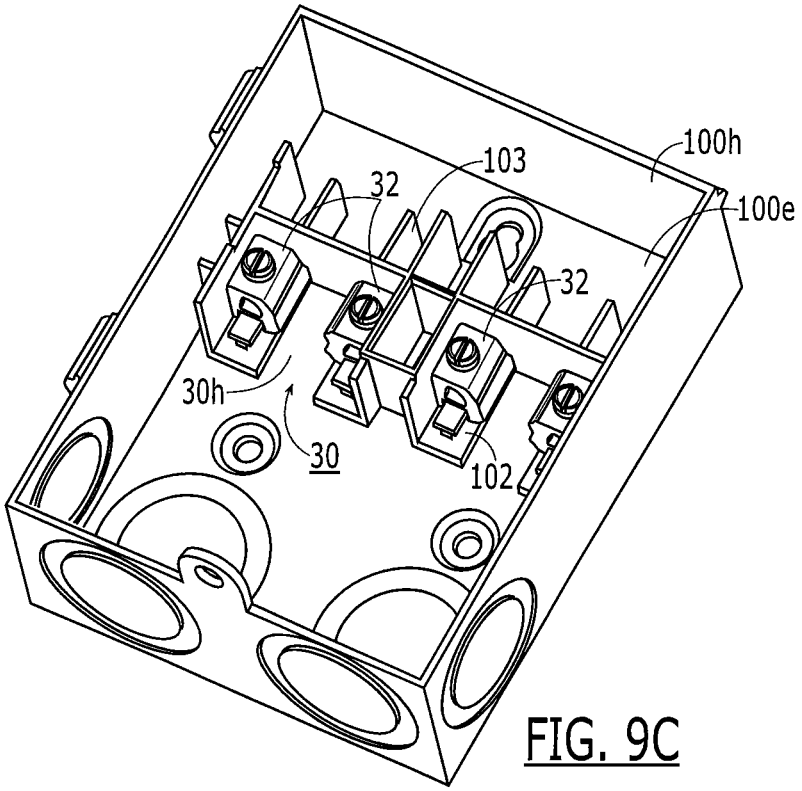
FIG. 9C is a front perspective view of the apparatus shown in FIG. 9A without the handle assembly and without the internal and external covers according to embodiments of the present invention.

FIG. 2 illustrates the handle assembly 20 disengaged from the lugs 32, the clips 25 can extend closer to compartment walls 103*w*, typically in the enclosure or housing 100*h* with the lug assembly 30 (FIG. 9C). The clips 25 (i.e., clip legs 25*l*) can flex and/or deflect side-to-side.

As shown in FIGS. 7A and 7B, the first end portions 26 of a clip body 25*b* (i.e., respective pairs of clips $25p_1$, $25p_2$) can be physically connected. The first and second pairs of clips $25p_1$, $25p_2$ can be physically connected by a laterally extending crown segment 26*c*. In other embodiments, neighboring clips 25 are discrete and unitary from each other and are not required to be physically connected.

The handle 22 can be grasped by a user when removing or inserting the handle pullout assembly 20 from the lug assembly 30. The base 21 can include an inwardly extending fin-shaped handle locator 29 (FIGS. 1 and 2, for example) that is configured to be inserted into a locator channel 39 to help properly locate the pullout assembly 20 with respect to the lug assembly 30.

Figure 6A:
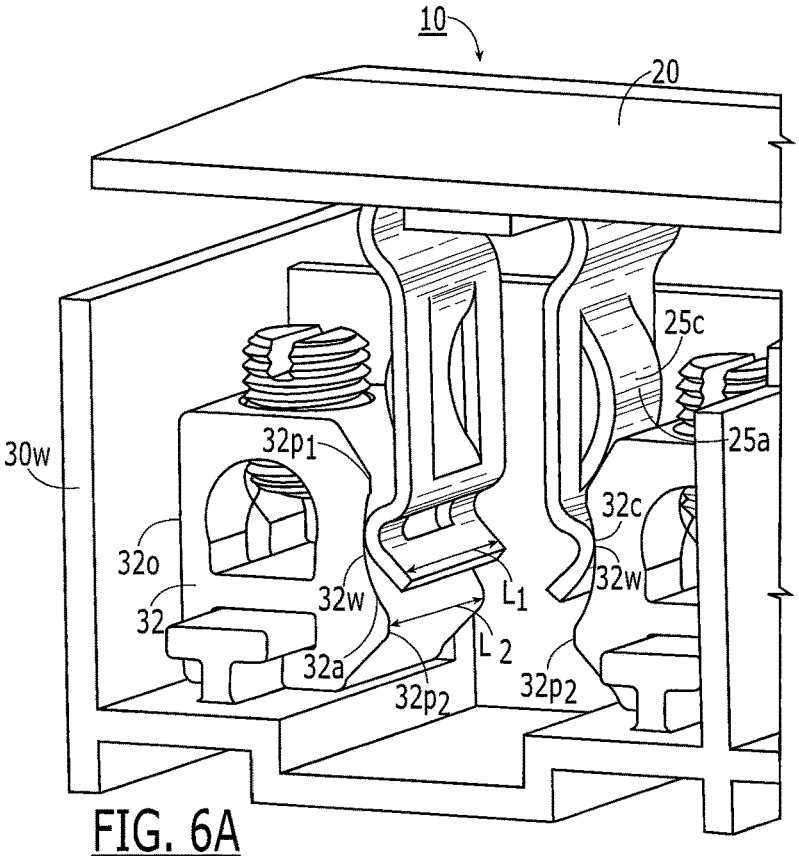
FIGS. 6A and 6B are enlarged, partial top perspective views of the disconnect assembly shown in FIG. 1 according to embodiments of the present invention.
Figure 6B:
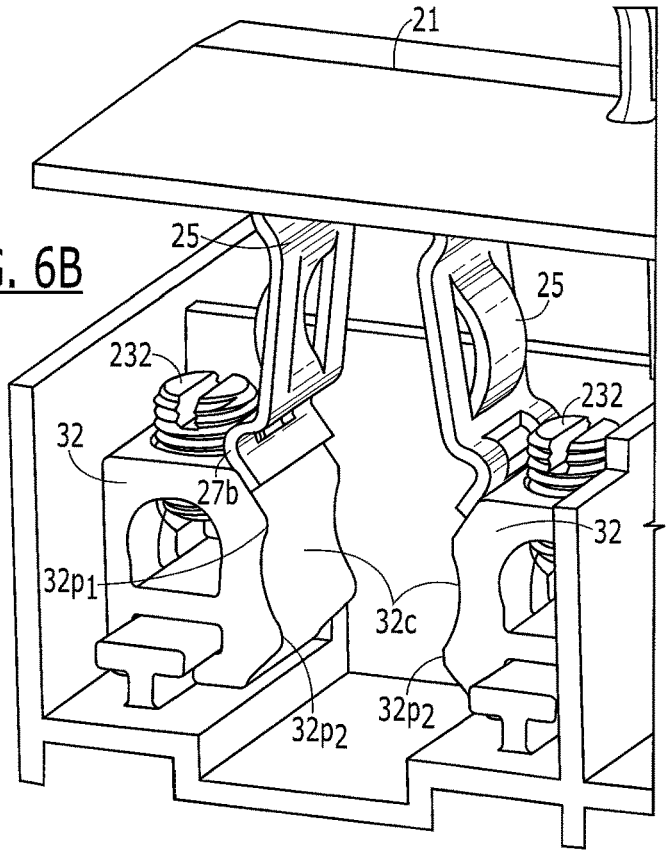

Referring to FIG. 6A, the lug 32 can have a sidewall 32*w* with a length L2 and the clip 25 can have a length L1, typically L1≤L2 The length dimension is typically vertical in a use configuration (see, e.g., FIG. 3) but is shown as horizontal in FIG. 6A. In other embodiments, L2≥L1. In some embodiments, L1 is in a range of 50%-150% of L2. In some embodiments, L1 and L2 are between 0.25 inches and 2 inches, more typically between 0.3 inches and 1 inch, such as about 0.3 inches, about 0.4 inches, about 0.5 inches, about 0.6 inches, about 0.7 inches, about 0.8 inches and about 0.9 inches.

When the handle pullout assembly 20 is inserted into the lug assembly 30, a clip body 25*b* and/or a first pair of clips $25p_1$ with conductive connector clips $25_1$, $25_2$ can contact and electrically engage the lugs $32_1$, $32_2$ to complete the circuit for a first phase of an air conditioning circuit and the second pair of clips $25p_2$ with conductive connector clips $25_1$, $25_2$ can contact and electrically engage the lugs $32_3$, $32_4$ to complete a circuit for a second phase of the air conditioning circuit.

The at least one lug 32 can be held in place in the base housing 30*h* by a T-shaped rail 23 that engages a cooperating slot 33 in the lug 32. However, as shown in FIG. 3B, the reverse configuration may be used, i.e., the at least one lug 32 can have a recess 33*r* that engages a rail 23*r* molded into a floor or back wall of (or even insert held by) the base housing 30*h*. To assemble, the slot 33 of the lug 32 can align with and slide over the rail 23 or the lug rail 33*r* can slide into the slot/recess 23*r* of the base housing 30*h*. The molded material of the interface between the lug and housing can be deformed once the lug is in a desired position to inhibit movement out of position. Physical stops or other attachment configurations or features may be used.

Where more than one lug 32 is used, one or some of the lugs 32 can have a rail while one or more others can have a recess for securing a respective lug 32, in position in the housing 30*h*. Also, physical fasteners may be used rather than and/or with the cooperating base housing 30*h* and lug 32 features.

Figure 9D:
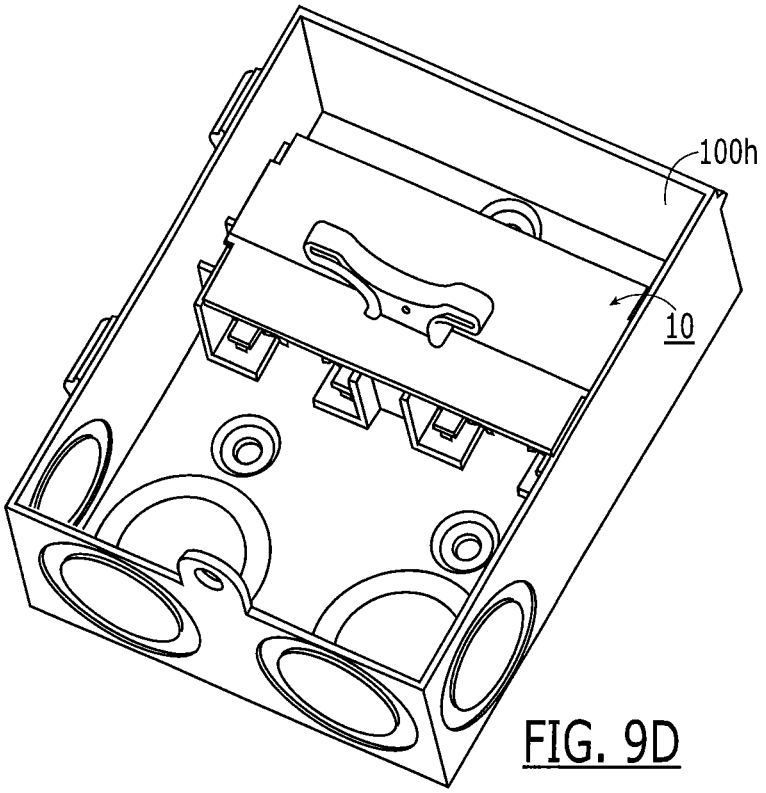
FIG. 9D is a front perspective view of the apparatus shown in FIG. 9A with the handle assembly engaging the lug assembly and without the covers according to embodiment s of the present invention.
Figure 9E:
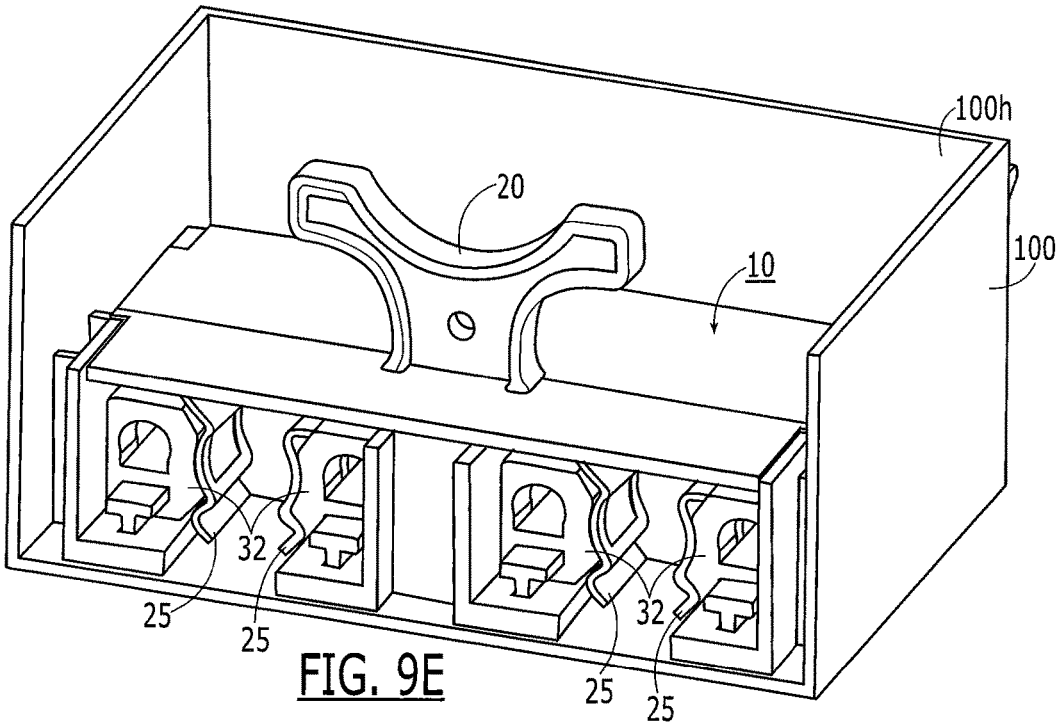
FIG. 9E is a partial cutaway view of the housing shown in FIG. 9A illustrating the handle assembly engaged with the lug assembly in an ON position according to embodiments of the present invention.
Figure 9F:
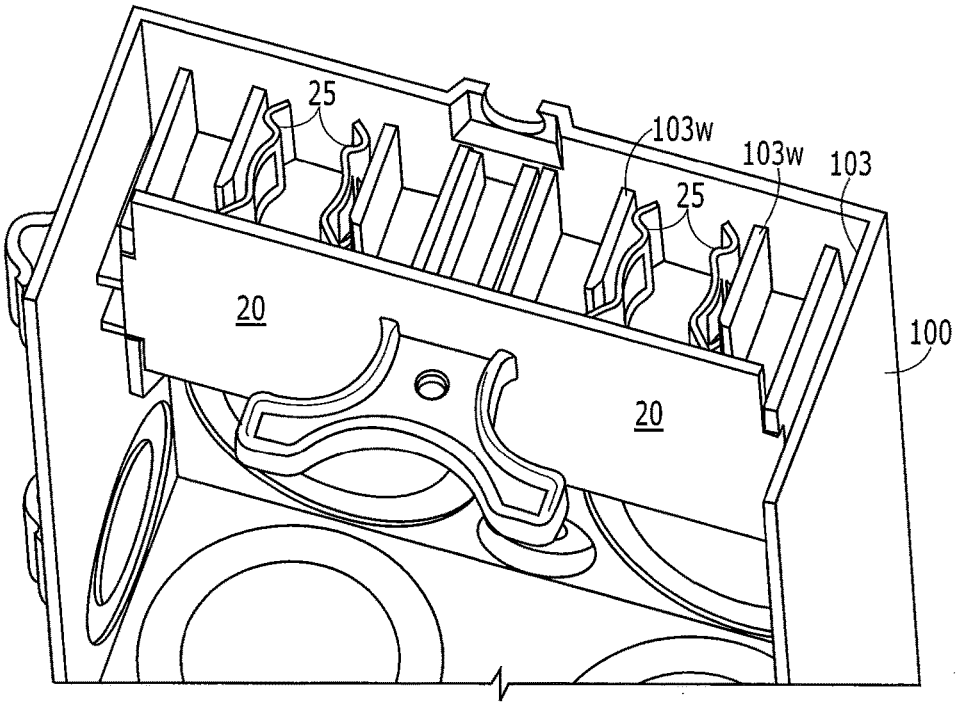
FIG. 9F is a partial cutaway view of the housing shown in FIG. 9A illustrating the handle assembly decoupled from the lug assembly in an OFF position (and with the handle assembly stored in the housing) according to embodiments of the present invention.

The disconnect assembly 10 can be held in an electrical apparatus 100 with a housing 100*h* providing an internal cavity or enclosure 100*e* as shown in FIGS. 9A-9F. FIG. 9A illustrates an example of a lid or cover 100*c* that attaches to the housing 100*h* enclosing the lug assembly 30. FIG. 9B illustrates the housing 100*h* with the external cover 100*c* removed and showing the disconnect assembly 10 adjacent an inner cover 100*ic* that can block a user's access to the underlying components unless the handle assembly 20 is removed from the lug assembly 30 (for a conduction OFF status) as is well known. FIGS. 9D and 9E illustrate the disconnect assembly 10 in an ON position/configuration with the handle assembly 20 engaged with the lug assembly 30. FIG. 9C illustrates the housing 100*h* with adjacent compartments 102, 103. One compartment 102 holds the lug assembly 30 with lugs 32 and housing components 30*h*. The other compartment 103 is sized and configured to releasably hold the handle assembly 20 in an OFF position in the housing 100*h* as shown in FIG. 9F.

The cover 100*c* can be coupled to the housing 100*h* and can be locked to the enclosure to prevent access to the components within the enclosure. As discussed in the Background, service personnel may lock the lid to the enclosure to prevent others from reconnecting the electrical power to a device they are servicing. As discussed above, the disconnect assembly 10 may be particularly suitable as an air conditioning disconnect unit, however the present invention can be practiced in any device that selectively interrupts power on an electrical circuit. In contrast to conventional pull out assemblies, embodiments of the invention are bladeless and do not require jaws attached to the lugs. Rather, the clips directly engage the lugs which engage stationary contacts to respectively bridge aligned pairs of such stationary contacts, thereby completing a circuit from an electrical source to a load.

It is also contemplated that the pull out clip and lug assemblies may further comprise blade and jaw members as supplemental or additional connections but it is not contemplated that such is required as this can add cost and complexity to the design.

Figure 10:
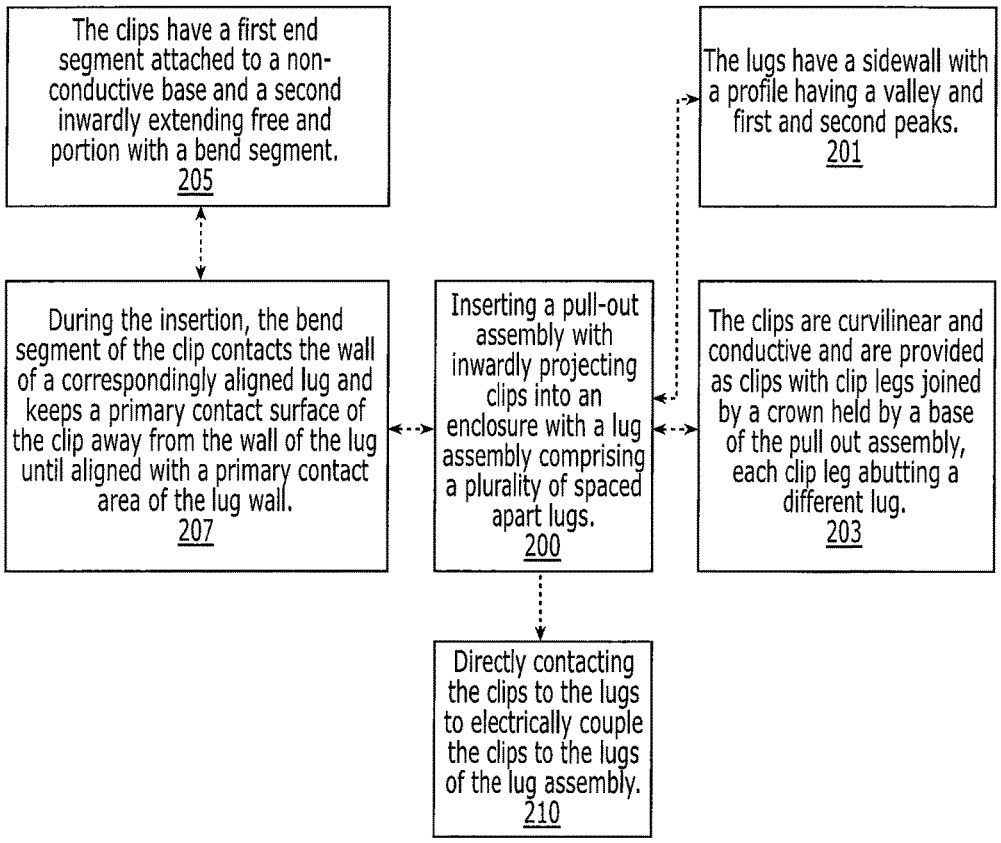
FIG. 10 is a flow chart of actions for connecting an electric circuit using a disconnect assembly according to embodiments of the present invention.

FIG. 10 is a flow chart of a method for connecting and disconnecting a disconnect assembly to a circuit according to embodiments of the present invention. A pull-out assembly with inwardly projecting clips is inserted into an enclosure with a lug assembly comprising a plurality of spaced apart lugs (block 202). The clips directly contact the lugs to electrically couple the clips to the lugs of the lug assembly (block 210).

The lugs can have a sidewall with a profile having a valley and first and second peaks (block 201).

The clips can be curvilinear and conductive and can be provided as clip bodies having first and second clip legs joined by a crown held by a base of the pull out assembly, each clip leg abutting a different lug (block 203).

The clips can have a first end segment attached to a non-conductive base and a second inwardly extending free end portion with a bend segment (block 205). During the insertion, the bend segment of the clip can contact the wall of a correspondingly aligned lug and keep a primary contact surface of the clip away from the wall of the lug until aligned with a primary contact area of the lug wall (block 207).

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A disconnect assembly, comprising:

a lug assembly with at least one lug held in a non-conductive lug housing; and a pull out disconnect assembly comprising a non-conductive base holding at least one inwardly extending electrically conductive clip, wherein one of the at least one inwardly extending clip abuts an outer wall of one of the at least one lug, and wherein the at least one inwardly extending clip comprises at least one clip leg with a free end portion and an outwardly projecting medial portion that extends laterally outward less than the free end portion when disassembled and, in operative position, abuts the outer wall of one of the at least one lug.

2. A disconnect assembly, comprising:

a lug assembly with at least one lug held in a non-conductive lug housing; and a pull out disconnect assembly comprising a non-conductive base holding at least one inwardly extending electrically conductive clip, wherein one of the at least one inwardly extending clip abuts an outer wall of one of the at least one lug, wherein the outer wall of the at least one lug comprises a profile with first and second peaks separated by a valley, and wherein the valley defines a primary electrical contact surface for electrical engagement with a primary contact surface at a medial segment of a respective clip during normal operation.

3. The disconnect assembly of claim 2, wherein the pull out disconnect assembly comprises a handle, wherein the first peak is closer to the handle than the second peak, and wherein the second peak projects outward from the valley further than the first peak.

4. A disconnect assembly, comprising:

a lug assembly with at least one lug held in a non-conductive lug housing; and a pull out disconnect assembly comprising a non-conductive base holding at least one inwardly extending electrically conductive clip, wherein one of the at least one inwardly extending clip abuts an outer wall of one of the at least one lug, wherein the at least one clip comprises at least one clip body with downwardly extending first and second legs joined by a crown segment, wherein the crown segment is held by a base of the pull out assembly, wherein the first and second legs have a free end portion with an arcuate bend that is spaced apart from a medial segment that has an arcuate portion, wherein the arcuate portion defines a primary contact surface that engages a medial segment of the outer wall of the lug during operation, and wherein the first leg contacts a first lug of the at least one lug and the second leg contacts an adjacent spaced apart second lug of the at least one lug in a space between the first and second lugs.

5. A disconnect assembly, comprising:

a lug assembly with at least one lug held in a non-conductive lug housing; and a pull out disconnect assembly comprising a non-conductive base holding at least one inwardly extending electrically conductive clip, wherein one of the at least one inwardly extending clip abuts an outer wall of one of the at least one lug, wherein the lug assembly is held in a non-conductive lug housing, wherein the at least one lug is a plurality of spaced apart lugs held in the lug housing, wherein the at least one clip is provided as first and second clip bodies, each with first and second inwardly extending clip legs joined by a crown at a first end portion, wherein the crown is attached to a non-conductive base of the pull-out disconnect assembly.

6. The disconnect assembly of claim 5, wherein the first and second clip legs face each other and reside inside a space between pairs of adjacent lugs.

7. The disconnect assembly of claim 5, wherein the first and second clip legs include a medial segment spaced apart from the first end segment between the first end segment and a second free end segment, wherein the medial segment comprises an arcuate portion that defines a primary electrical contact surface with a primary contact surface of an aligned one of the lugs and has an angular extent in a range of 30-90 degrees, and wherein the free end segment comprises a window that resides below or behind the primary contact surface of the clip leg.

8. The disconnect assembly of claim 7, wherein the second free end segment has an arcuate bend and has a linear extent that is less than a linear extent of the arcuate portion, and wherein, the primary contact surface of the lugs has an arcuate profile that corresponds to the primary contact surface of the clip legs.

9. The disconnect assembly of claim 6, wherein the adjacent lugs include first and second lugs with an inner facing sidewall with a curved valley that faces each other as the outer wall that abuts a respective clip, wherein the inner facing sidewall of the first lug abuts the first leg and the inner facing sidewall of the second lug abuts the second leg.

10. The disconnect assembly of claim 5, wherein the lug housing comprises a back wall or floor with a molded rail or a molded slot that slidably receives a matable feature in the lug.

11. An electrical apparatus comprising:

an enclosure;

a lug assembly comprising an electrically non-conductive lug housing attached to a back wall of the enclosure, and a plurality of inwardly extending lugs with an inner facing sidewall having a profile with a valley separating first and second peaks, wherein the valley provides a primary electrical contact surface; and a pullout disconnect assembly with a handle and a plurality of inwardly extending curvilinear clip legs, wherein the clip legs abut and directly electrically engage respective lugs to thereby provide an electrical path for current from a conductor held by the lug to an electrical circuit.

12. The apparatus of claim 11, wherein a medial segment of the clip legs comprise an arcuate portion that provides a primary contact surface with the primary electrical contact surface of the lugs during operation.

13. The apparatus of claim 11, wherein the first peak is closer to the handle than the second peak, and wherein the second peak projects outward from the valley further than the first peak.

14. The apparatus of claim 12, wherein the clip legs are provided as first and second clip bodies, each with downwardly extending first and second legs as the clip legs, joined by a crown segment, wherein the crown segment is held by a base of the pull out disconnect assembly, wherein the first and second legs of the first and second clip bodies each have a free end portion with an arcuate bend that is spaced apart from the medial segment, and wherein the first leg contacts a first lug and the second leg contacts an adjacent spaced apart second lug inside a space between the first and second lugs of the plurality of lugs of the lug assembly.

15. The apparatus of claim 11, wherein the crown is attached to a non-conductive base of the pull-out disconnect assembly.

16. The apparatus of claim 11, wherein first and second neighboring clip legs face each other and reside inside a space between adjacent lugs.

17. The apparatus of claim 12, wherein the arcuate portion of the medial segment has an angular extent in a range of 30-90 degrees, and wherein the legs have a width that is in a range of 0.25 inches and 1 inch.

18. The apparatus of claim 14, wherein the free end segment has an arcuate bend and has a linear extent that is less than a linear extent of the arcuate portion, and wherein, the primary contact surface of the lugs has an arcuate profile that corresponds to the primary contact surface of the clip legs.

19. The apparatus of claim 11, wherein the lug housing comprises a back wall or floor with a molded rail or a molded slot that slidably receives a matable feature in the lug.

20. A method of engaging and disengaging lugs in a disconnect assembly, comprising:

inserting a handle comprising a plurality of inwardly extending laterally spaced apart clip legs into a housing holding a lug assembly with a plurality of laterally spaced apart lugs;

in response to the inserting, the clip legs directly contact adjacent curvilinear outer walls of the lugs to move free end portions of the clip legs closer together relative to a disconnected position and electrically connect the clip legs to the lugs and connect an electrical circuit; and pulling the handle with the clips outward away from the lugs to separate the clips from the lugs and disconnect the electrical circuit.

21. The method of claim 20, wherein the lugs have a curvilinear wall, and wherein the clip legs comprise an outer facing projection that abut a valley in the curvilinear wall and define a primary contact surface.

* * * * *